US005330868A

United States Patent [19]

Santilli et al.

[11] Patent Number: 5,330,868

[45] Date of Patent: Jul. 19, 1994

[54] ELECTROGRAPHIC FLUORESCENT LIQUID DEVELOPER

[75] Inventors: Domenic Santilli, Webster; John W. May, Rochester, both of N.Y.

[73] Assignee: Eastman Kodak Company, Rochester, N.Y.

[21] Appl. No.: 941,829

[22] Filed: Sep. 8, 1992

Related U.S. Application Data

[62] Division of Ser. No. 742,139, Aug. 8, 1991, Pat. No. 5,176,980.

[51] Int. Cl.[5] ..... G03G 9/09; G03G 9/125

[52] U.S. Cl. ..... 430/106; 430/116; 430/114; 430/137; 355/233; 355/257

[58] Field of Search ..... 430/106, 114, 116, 137

[56] References Cited

U.S. PATENT DOCUMENTS 4,308,327 12/1981 Bird et al. ..... 430/15

4,741,643 6/1973 Smith et al. ..... 430/117 X 4,865,937 9/1989 Santilli et al. ..... 430/137

5,192,638 3/1993 Landa et al. ..... 430/137

*Primary Examiner*—Roland Martin

*Attorney, Agent, or Firm*—William F. Noval

[57] ABSTRACT

An electrographic liquid developer includes a fluorescent toner diluted in a liquid developer vehicle which has a high flash point and a low vapor pressure. The liquid developer vehicle preferably is a mixed liquid alkane which has a flash point over 140° F. and a vapor pressure less than 5.2 mm of mercury at 38° C. The fluorescent toner is preferably made as follows:

a solution is prepared which comprises an organic solvent, a fluorescent dye, and an organic polymer. A pigment is precipitated by mixing the solution with a non-solvent for the polymer in the presence of a dispersant. The pigment is melt-compounded with a polymeric organic binder and the melt-compounded mixture is comminuted.

9 Claims, No Drawings

ELECTROGRAPHIC FLUORESCENT LIQUID DEVELOPER

CROSS REFERENCE TO RELATED APPLICATIONS

This application is a divisional application of U.S. Pat. application Ser. No. 742,139, filed Aug. 8, 1991 U.S. Pat. No. 5,176,980 entitled "An Electrographic Liquid Developer and Method of Making Same", inventors Domenic Santilli and John W. May.

FIELD OF INVENTION

This invention relates in general to the field of electrography and to an electrographic liquid developer and method of making same. More particularly, this invention relates to a fluorescent toner electrographic liquid developer which has a high flash point and a low vapor pressure and relates to a method of making same.

BACKGROUND OF THE INVENTION

In electrostatography, a latent electrostatic image is formed on an insulating substrate such as a photoconductor. This image can be formed by a variety of methods including the use of light of visible or non-visible (e.g., x-ray) wavelength, or electronically by electrographic recording. Imagewise charge patterns can also be made by other electrostatographic means such as ionography and ion projection. The latent electrostatic image can be developed (i.e., made visible) by the application of a developer containing charged colored particles, called toner particles, to the latent image. The charged toner particles adhere to the latent image in proportion to the imagewise potential difference. The developer can be either a dry powder or dispersed toner particles in an electrically insulating liquid.

While it is not necessary for toners used in many electrostatographic processes to be fluorescent, fluorescent toners are very advantageous if the toners are to be used in xeroradiography. (See, for example, U.S. Pat. Nos. 2,817,767 and 2,856,535.) Briefly, in xeroradiography, a charged photoconductor is exposed to x-rays which has passed through an object (e.g., a portion of a human body) of which one wishes to obtain an x-ray image, forming a latent electrostatic x-ray image on the photoconductor. The latent image is toned with a fluorescent toner and the toned image is exposed to light. The image fluoresces in proportion to the amount of fluorescent toner that is present and can be photographed or used to expose a photoconductor for xerographic copying. The use of a fluorescent dye in this process enhances the contrast of the image and reduces the intensity of the x-rays needed to form the image.

Fluorescent dyes do not themselves have properties that toners must have to develop an electrostatic latent image. Thus, a fluorescent toner must be made by incorporating a fluorescent dye into a polymeric binder (with other components). When certain fluorescent dyes are directly mixed with suitable binders by melt-compounding and grinding, the most common method of preparing a toner, the electrical properties of the toner are disturbed, so that images formed with the toner are of poor quality. Moreover, if the toner formulation is optimized for a particular dye, the formulation may not be optimum for a different dye.

If the fluorescent dye is not melt-compounded with the binder, but is merely mixed with it, the dye may not fluoresce, or may not fluoresce well, because it is not in solid solution in the binder. While a solid solution of the dye can be made by forming a solution of the binder and the dye and removing the solvent, this procedure cannot be used when the binder is insoluble or is not soluble in commonly used or non-toxic solvents. Also, toners prepared in this manner may have inferior properties, such as unstable charging characteristics, compared to toners prepared by melt-compounding.

In addition to maintaining the electrical properties of the toner and the fluorescence of the dye, a procedure for making a fluorescent toner should also be capable of producing a toner of small particle size (e.g., less than a micrometer for liquid toners and less than 20 micrometers for dry toners), since high resolution images require smaller sized toners. If a pigment particle is to be incorporated into a toner particle without substantially altering its characteristics, the pigment particle must be small enough, relative to the toner particle, so that its properties do not significantly perturb the properties of the particle as a whole. A good procedure for making a fluorescent toner should therefore make or use small pigment particles (e.g., less than one micrometer).

In commonly assigned U.S. Pat. No. 4,865,937, issued Sep. 12, 1989, inventors D. Santilli and J. W. May, there is disclosed method of making a fluorescent toner based on the discovery that fluorescent dyes can be incorporated into toners without adversely affecting the electrical properties of the toner or the fluorescence of the dye if the dye is first made into a fluorescent pigment, and then the pigment is melt-compounded with the toner binder. (Herein, "pigment" means a fluorescent phase, separate from the binder, in which a fluorescent dye is dissolved in an organic polymer. "Fluorescent" means emitting light after excitation and may include luminescent, phosphorescent, and scintillating.) The pigment is prepared by mixing a solution of the dye and an organic polymer with a non-solvent in the presence of a dispersant. This procedure precipitates submicrometer sized pigment particles, which can be incorporated into small toner particles without substantially altering the electrical surface characteristics of the toner particles.

As disclosed in the latter patent, an electrographic liquid developer is made by diluting the fluorescent toner in a developer vehicle having a low flash point and high evaporation rate. This liquid developer may not be appropriate in applications where it is desirable to keep the liquid toned image wet for a period of time for further image processing. Moreover, a low flash point, high evaporation rate liquid developer imposes safety considerations during storage and transportation, increases the cost of disposal of spent developer liquid and increases the cost and complexity of manufacturing electrographic equipment using such liquid developer. In addition, to meet government regulatory requirements for managing emissions of organic vapors generated by evaporation of a low flash point, high evaporation rate liquid developer is expensive.

SUMMARY OF THE INVENTION

According to the present invention, there is provided an electrographic liquid developer including a fluorescent toner diluted in a high flash point, low vapor pressure liquid developer vehicle. The liquid developer vehicle preferably has a flash point greater than 140° F. and is a complex mixture of liquid alkanes. The fluorescent toner is preferably made as follows: a solution is prepared which comprises an organic solvent, a fluorescent dye, and an organic polymer. The pigment is precipitated by mixing the solution with a non-solvent for the polymer in the presence of a dispersant. The pigment is melt-compounded with a polymeric organic binder and the melt-compounded mixture is comminuted.

The electrographic liquid developer of the present invention has the following advantages:

1. Improved safety during storage and transportation of developer.

2. Cost of disposal of spent developer liquid is reduced.

3. Cost of manufacturing electrographic equipment using developer liquid is reduced.

4. Compliance with government regulatory requirements for managing emissions of organic vapors generated by evaporation of developer vehicle inside electrographic equipment is reduced in cost and complexity.

DESCRIPTION OF THE PREFERRED EMBODIMENTS

In commonly assigned U.S. Pat. No. 5,125,013, issued Jun. 23, 1992, there is disclosed a novel and nonobvious method of scanning an electrographic toner image formed on a support (such as a photoconductor) through a liquid layer.

In a preferred embodiment, a fluorescent toned image prepared electrophotographically on a selenium plate photoconductor is raster scanned by a laser to produce an image-wise optical emission that is detected photoelectrically to produce an electrical image signal. In this preferred embodiment, the electrographic liquid developer is prepared with toner particles suspended in a vehicle of mixed alkane solvent. The toned image on the selenium plate is rinsed with a mixed alkane solvent, and then scanned in a liquid gate containing mixed alkane solvent. It is desirable to use for the liquid developer an alkane vehicle that has a high flash point and a low vapor pressure for improved safety when it is being used in the electrographic development process. Moreover, it is desirable to have a high flash point and low vapor pressure for the liquid developer vehicle so that there is improved safety during storage and transportage of the developer. In addition, the cost of disposal of spent developer liquid and the cost of manufacturing the electrographic equipment are both reduced when a low vapor pressure, high flash point liquid is used as the developer vehicle. The regulatory requirements for managing emissions of organic vapors generated by evaporation of said vehicle inside the electrographic equipment can be complied with less expensively when a low vapor pressure vehicle is employed. For these reasons, it is desirable to provide a liquid developer made with a vehicle consisting of a high flash point, low vapor pressure liquid, such as an alkane solvent or other suitable solvents useful in the preparation of electrographic liquid developers.

TABLE 1

| | Comparisons of ISOPARS* | | | |
|---|---|---|---|---|
| ISOPAR | Flash Point (°F.) | Average Molecular Weight (grams) | Evaporation Rate** | Vapor Pressure (mm Hg @ 38° C.)*** |
| G | 105 | 149 | 0.3 | 14.0 |
| L | 142 | 171 | <0.1 | 5.2 |

TABLE 1-continued

| | Comparisons of ISOPARS* | | | |
|---|---|---|---|---|
| ISOPAR | Flash Point (°F.) | Average Molecular Weight (grams) | Evaporation Rate** | Vapor Pressure (mm Hg @ 38° C.)*** |
| M | 170 | 191 | <0.1 | 3.1 |

*complex mixtures of liquid alkanes manufactured by Exxon.
**n-butyl acetate = 1; data taken from U.S. Department of Labor Material Safety Data Sheets, published August 10, 1979.
***From publication A5 SM 4/90, Copyright 1990 by Exxon Chemical Company.

In a preferred embodiment of the present invention which is useful in the method disclosed in the above mentioned copending application, there is provided an electrographic liquid developer having a high flash point and low vapor pressure. The liquid developer vehicle preferably has a flash point greater than 140°. A vapor pressure at 38° C. of less than 5.2 mm of mercury is also preferred. As shown in Table 1, the complex mixtures of liquid alkanes manufactured and sold as ISOPAR L and ISOPAR M are suitable for use in the present invention. Other high flash point, low vapor pressure liquid vehicles are also suitable.

The fluorescent toner is preferably made as follows.

In the first step of making the preferred fluorescent toner, a solution is prepared which comprises an organic solvent, a fluorescent dye, and an organic polymer. The concentrations of dye and polymer in the solution are preferably near or at their saturation levels in the solvent. The saturation levels will depend upon the particular materials selected. A typical weight ratio of dye to polymer in the solution is about 0.001 to about 0.05. More dye may cause the dye to crystallize inside the pigment which may result in a loss of fluorescence, and less dye may not produce a very fluorescent toner. The total amount of dye plus polymer in the solution is typically about 1 to about 20% by weight of the solution weight, as a higher concentration may result in pigment particles that are too large to be well dispersed in a melt, and a lower concentration may produce pigment particles that are too small which can result in a toner having low covering power.

Any organic solvent in which the dye and polymer will dissolve can be used in forming the solution. Examples of organic solvents that may be suitable, depending upon the particular dye and polymer selected, include 2-vinyl pyrrolidone, N-methyl pyrrolidone, glycol ethyl ether, hydroxyethyl acetate glycol monoacetate, ethyl acetate, diethyl ether, dimethyl formamide, dimethylacetamide, ethyl alcohol, acetone, methyl isobutyl ketone, methyl ethyl ketone, sulfolane, benzene, toluene, xylene, and dichloromethane. Acetone is preferred because it is a particularly good solvent for cellulosic polymers.

The organic polymer must be soluble in the solvent and, when it precipitates with the dye, must form a solid solution with the dye. An advantage of this invention is that polymers that are infusible at a low temperature (e.g., below about 200° C.), or that cannot be easily ground, such as cellulose and high molecular weight polymers, can be used to form the pigment. Examples of other suitable polymers include polyesters, vinylic and acrylic addition-type polymers and copolymers, hydroxy polyvinyl polymers, and polyvinyl alcohol and esters thereof. Cellulosic polymers are preferred because rhodamine dyes, the preferred dyes, fluoresce more with cellulosic polymers. Examples of suitable polymers include cellulose, cellulose acetate, cellulose acetate phthalate ("CAP"), cellulose acetate hexahydrophthalate ("CAP-6"), cellulose acetate trimillitate ("CAT"), hydroxypropyl methyl cellulose phthalate, hydroxypropyl cellulose and hydroxyethyl cellulose.

The preferred cellulosic polymer is "CAP-6" because it is polar, which enables it to form a better molecular dispersion with cationic dyes such as rhodamine dyes, and to precipitate as smaller particles.

Any fluorescent dye which is soluble in an organic solvent and which will form a solid solution in the pigment with the organic polymer can be used in making the solution. Examples of fluorescent dyes include rhodamine dyes, rosaniline, and fluorescein dyes. Rhodamine dyes are preferred because of their high quantum efficiency in fluorescence. Examples of rhodamine dyes include Rhodamine 6G (C.I. 45160), Rhodamine 6G Perchlorate, Rhodamine 6G Tetrafluoroborate, Rhodamine B (C.I. 45170), Rhodamine 3B Perchlorate, Rhodamine S (C.I. 45050), Rhodamine 19 Perchlorate, Rhodamine 101 Inner Salt, Rhodamine 110, Rhodamine 116, Rhodamine 123, and Solvent Rhodamine B conc. (C.I. 45170B). The preferred rhodamine dyes are the Rhodamine triflates, which are the trifluoromethane sulfonate salts of the rhodamine dyes, because of their high fluorescence efficiency. (See U.S. Pat. No. 4,711,832.) Especially preferred is the triflate of the methyl ester of Rhodamine B.

In the second step of the method of making the preferred fluorescent toner, fluorescent pigment is precipitated by mixing the solution of the solvent, organic polymer, and fluorescent dye with a non-solvent in the presence of a dispersant. The dispersant performs the function of preventing the precipitating pigment particles from agglomerating or coalescing. If the dispersant is not present, large pigment particles are formed which cannot be used without grinding, and grinding significantly adds to the cost of preparing a toner, especially with polymers such as cellulose, which cannot be easily ground. The dispersant must be in solution, but can be dissolved in either the solvent or the non-solvent for the polymer; it is preferably dissolved in the solvent along with the polymer and the dye, as that requires less dispersant and may result in smaller pigment particles. The dispersant must be soluble in the solvent, but dispersants which are not readily soluble in the solvent can sometimes be used if they are predissolved in another solvent, such as dichloromethane, that is miscible with the solvent from which precipitation of the pigment occurs. The dispersant should also be soluble in the non-solvent so that it can be easily separate from the pigment when the pigment is precipitated. The concentration of dispersant in the solution should be sufficient to prevent the precipitated pigment particles from agglomerating to a particle size greater than 1 μm; preferably, the particles have a particle size of less than 0.1 μm because for liquid developers it is desirable to prepare toner particles that are not much larger. Particles of that size can generally be obtained by using a weight ratio of dispersant to dye plus polymer in the solution of about 0.11 to about 2. More dispersant is difficult to dissolve and serves no useful purpose, and less dispersant may result in pigment particles that are too large. Surfactants or charge control agents that cause the precipitating pigment particles to repel so that they do not agglomerate into large particles can be used as dispersants. Examples of nonpolymeric dispersants include salts of such fatty acids as stearic acid, palmitic acid, and lauric acid. Polymeric dispersants are preferred because they usually have better long term stability. Examples of polymeric dispersants include poly(sytrene-co-lauryl methacrylate-co-sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-styrene-co-lithium sulfoethyl methacrylate), poly(t-butylstyrene-co-lauryl methacrylate-co-lithium methacrylate), poly(t-butylstyrene-co-lithium methacrylate), poly(t-butylstyrene-co-lauryl methacrylate-co-lithium methacrylate), poly(t-butylstyrene-co-lithium methacrylate), poly(t-butylstyrene-co-lauryl methacrylate-co-lithium methacrylate-co-methacrylic acid), and poly(vinyltoluene-co-lauryl methacrylate-co-methacryloyloxyethyltrimethylammonium p-toluene-solfonate). (See U.S. Pat. Nos. 4,708,923 and 3,788,995, herein incorporated by reference.) The preferred polymeric dispersants are poly(t-butylstyrene-co-lithium methacrylate) and poly(t-butylstyrene-co-styrene-co-lithium sulfoethyl methacrylate) because they have been found to work well.

The non-solvent is a non-solvent for the polymer and the dye, but is a solvent for the dispersant. Examples of liquids which may be useful as non-solvents, depending upon the particular polymer, dye, and dispersant used, include water, alkanes such as butane, pentane, hexane, and heptane, and mixtures of alkanes. The preferred non-solvent is heptane because it evaporates quickly. A sufficient amount of non-solvent must be used to precipitate the pigment. Since the dispersant remains in solution it can be separated from the pigment so that it does not contaminate or dilute the pigment. Separation can be accomplished by, for example, filtration or centrifugation; filtration is preferred. The pigment comprises the dye in solid solution with the polymer (i.e., the dye is molecularly dispersed in the polymer, forming a continuous phase with it). For many dyes, such as the rhodamine dyes, a solid solution is required in order to achieve fluorescence. No chemical reaction occurs between the dye and the polymer in forming the pigment because separation of the dye from the polymer can be achieved by physical means such as, for example, dissolution of the pigment in a solvent followed by precipitation of the polymer by addition of a liquid that is a non-solvent for the polymer but a solvent for the dye.

In the third step of the method of making the preferred toner, the pigment is melt-compounded with a polymeric organic binder. Merely mixing the pigment with the binder does not produce a good toner because the charge on the toner is less stable and fluctuates with relative humidity, resulting in a wide variance in image quality. Melt-compounding consists of mixing the pigment and the binder together at a temperature sufficient to soften or melt the binder, as is well known in the art. The pigment should be about 10 to about 60% by weight of the mixture, based on the total solids weight. The toner binder must be thermoplastic if a fusible toner is to be obtained. The toner binder preferably has a glass transition temperature, $T_g$, of about 40° to about 100° C., and most preferably about 45° to about 65° C., as a lower $T_g$ may result in a clumping of the toner as it is handled at room temperature, while a higher $T_g$ renders the process of this invention too energy intensive. Preferably, dry toner particles have a relatively high caking temperature, for example, higher than about 60° C., so that the toner powders can be stored for relatively long periods of time at fairly high temperatures without individual particles agglomerating and clumping together.

The melting point of polymers useful as toner binders preferably is about 65° C. to about 200° C. so that the toner particles can be readily fused to a receiver to form a permanent image. Especially preferred polymers are those having a melting point of about 65° C. to about 120° C. The polymers useful as toner binders in the practice of the present invention can be used alone or in combination and include those polymers conventionally employed in electrostatographic toners. Among the various polymers which can be employed as binders in the present invention are polycarbonates, resin-modified maleic alkyd polymers, polyamides, phenolformaldehyde polymers and various derivatives thereof, polyesters condensates, modified alkyd polymers, aromatic polymers containing alternating methylene and aromatic units such as described in U.S. Pat. No. 3,809,554, and fusible crosslinked polymers as described in U.S. Pat. No. Re. 31,072.

Typical useful binder polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful binder polymers having the above-described physical properties include addition polymers of acrylic and methacrylic acid such as poly(alkyl acrylate), and poly(alkyl methacrylate) wherein the alkyl moiety can contain from 1 to about 10 carbon atoms. Additionally, polyesters having the aforementioned physical properties are also useful. Among such useful polyesters are copolyesters prepared from terephthalic acid (including substituted terephthalic acid), a bis(hdyroxyalkoxy)phenylalkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Other useful binder polymers are various styrene-containing polymers. Such polymers can comprise, e.g., a polymerized blend of from about 40 to about 100 percent by weight of styrene, from 0 to about 45 percent by weight of a lower alkyl acrylate or methacrylate having from 1 to about 4 carbon atoms in the alkyl moiety such as methyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g., styrene-butyl acrylateethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re 25,316; 2,788,288; 2,638,416; 2,618,552 and 2,659,670. Preferred toner binders are homopolymers and copolymers of styrene or a derivative of styrene and an acrylate, preferably butylacrylate.

Useful toner binders can simply comprise the polymeric binder particles but it is often desirable to incorporate addenda in the binder such as waxes, colorants, release agents, charge control agents, and other toner addenda well known in the art.

Dry toner particles can also incorporate magnetic material so as to form what is sometimes referred to as a "single component developer." A "two component developer" can also be made, where the toner particles are simply mixed with carrier particles.

In the final step of the method of making a preferred toner, the melt-compounded mixture of the pigment and the toner binder is comminuted to the desired particle size. The liquid developer is prepared, for example, by coarse pulversing followed by milling the coarse grind to a sub-micrometer particle size in an organic liquid non-solvent, having a high flash point and low vapor pressure.

The following examples further illustrate this invention.

EXAMPLE 1

Into 700 ml acetone was dissolved 35.0 g "CAP-6"; 0.33 g Rhodamine 6G was added and dissolved in the solution. To that solution was added 100.0 g of a 5 weight percent solution in dichloromethane of a dispersant (a copolymer of 97 weight percent 4-t-butylstyrene-3 weight percent lithium methacrylate). The mixture was then added to 2000 ml heptane while stirring. Sub-micrometer sized pigment particles were obtained which were isolated by filtration.

Ten grams of the pigment were melt-compounded with 20.0 g of a polyester (made from 53 mole percent methacryloyloxyethylacetoacetamide, 43 mole percent terephthalic acid, 4 mole percent sodium salt of 1.3-dimethyl 5-sulfoisophthalate (previous mole percentages based on total acid portion of the polyester), and 100 mole percent neopentylglycol (based on total hydroxyl portion of the polyester)), 5.0 g polyethylene wax sold by Eastman Kodak Co. under the trade designation "Epolene E-12," and 5.0 g copolymer of 78 mole percent ethylene and 22 mole percent vinyl acetate (to make the polyethylene wax compatible), sold by Dupont under the trade designation "Elvax 210." The thermoplastic mixture was pulverized and 10.0 g of the resulting dry toner was ball milled with 10.0 g of a charge agent which was a copolymer of 72 weight percent 4-t-butylstyrene—24 weight percent styrene—4 weight percent lithium sulfoethyl methacrylate and 4.0 g of the dispersant used above in 83.0 g of a mixed alkane ($C_8$ to $C_{13}$) solvent sold by Exxon under the trade designation "Isopar-G." The toner particle size was less than one micrometer, but the toner particles were larger than the pigment particles.

An electrographic liquid developer was prepared by diluting an aliquot of the mill grind in one liter of a mixed alkane solvent sold by Exxon under the trade designation "Isopar-M" to obtain a toner solids concentration of 4 g/L. The resulting developer was stored for 10 weeks, showing excellent stability. It was then tested in a conventional xerographic process using a selenium plate photoconductor obtained from Noranda Inc. of Quebec, Canada. The selenium thickness was 150 micrometers. The plate was charged by a corona charger to +1950 volts and then exposed to an x-ray radiation image using a Faxitron machine manufactured by the Hewlett-Packard Corporation. An exposure time of 53 sec was used at $KV_p=40$ kilovolts, with added filtration of 0.84 mm of aluminum. The x-radiation was transmitted to the charged selenium plate through a Kodak I.T.O. phantom (manufactured by Nuclear Associates) plus an added layer of Lucite of thickness 0.75 inch. The x-ray exposure was 196 milliroentgens. The exposed plate was developed using a conventional fountain-type development electrode, rinsed with "Isopar-M" in a fountain-type rinse station, and then skived with an air knife. The resulting toned image on the plate was damp. A time of 40 minutes drying time in undisturbed air was needed before the toned image appeared dry. The image examined under a microscope was sharp, and the image quality was excellent. Meshes, balls, filaments and other components of the phantom were all imaged with high fidelity. The fluorescence of the image was bright, useful and satisfactory.

EXAMPLE 2

The purpose of this Example is to provide a comparison with prior art. A toned image on a 150 mm selenium plate was prepared by a method entirely similar to that of Example 1, except that the developer was prepared according to Example 6 of U.S. Pat. No. 4,865,937, i.e. contained "Isopar-G" instead of "Isopar-M". After the last step, skiving by air knife, the toned image appeared dry without further waiting. The image quality was similar to that of Example 1. This Example also illustrates the much faster evaporation times for "Isopar-G" as compared to "Isopar-M" at room temperature. This faster evaporation is undesirable where the fluorescent toned image is to be scanned in a liquid gate.

The invention has been described in detail with particular reference to preferred embodiments thereof, but it will be understood that variations and modifications can be effected within the spirit and scope of the invention.

What is claimed is:

1. An electrographic liquid developer comprising an aliquot of fluorescent toner diluted in a liquid developer vehicle having a high flash point and a low vapor pressure.

2. An electrographic liquid developer of claim 1 wherein said liquid developer vehicle has a flash point greater than 140° F.

3. An electrographic liquid developer of claim 1 wherein said liquid developer vehicle is a mixed liquid alkane which has a flash point greater than 140° F. and has evaporation rate less than 0.1 of that of n-butyl acetate.

4. An electrographic liquid developer of claim 3 wherein said liquid developer vehicle has vapor pressure at 38° C. of less than 5.2 millimeters of mercury.

5. An electrographic liquid developer having a fluorescent toner for use in electrostatography made according to the method:

making a fluorescent toner by preparing a solution which comprises:

organic solvent;

a fluorescent dye soluble in said solvent; and an organic polymer soluble in said solvent;

mixing said solution with a sufficient amount of a liquid which is a non-solvent for said polymer to precipitate particles of a pigment which comprises said dye in solid solution with said polymer, said mixing being in the presence of a dispersant soluble in said non-solvent in an amount sufficient to prevent said precipitating pigment particles from agglomerating to a particle size greater than 1 μm;

melt-compounding a mixture which comprises polymeric organic binder and said pigment;

comminuting said melt-compounded mixture; and diluting an aliquot of said fluorescent toner in a liquid developer vehicle having a high flash point and a low vapor pressure.

6. In an electrographic imaging system in which a latent electrographic image is formed on a photoconductive or dielectric surface, is developed into a toner image by means of a liquid fluorescent toner, the toned image is raster scanned by a beam of light to produce an image wise optical emission, and the image wise optical emission is detected photoelectrically to produce an electrical image signal, the improvement comprising:

the use of an electrographic liquid developer comprising an aliquot of fluorescent toner diluted in a liquid developer vehicle having a high flash point and a low vapor pressure.

7. The improvement of claim 6 wherein said electrographic liquid developer has a liquid developer vehicle with a flash point greater than 140° F.

8. The improvement of claim 6 wherein said liquid developer vehicle is a mixed liquid alkaline which has a flash point greater than 140° F. and has an evaporation rate less than 0.1 of that of small n-butyl acetate.

9. The improvement of claim 6 wherein said liquid developer vehicle of said electrographic liquid developer has vapor pressure at 38° C. of less than 5.2 mm of mercury.

* * * * *